US010355413B2

(12) United States Patent
Leconte

(10) Patent No.: US 10,355,413 B2
(45) Date of Patent: Jul. 16, 2019

(54) ELECTRICAL CONNECTION

(71) Applicant: Goodrich Actuation Systems SAS, Buc (FR)

(72) Inventor: Philippe Leconte, Poissy (FR)

(73) Assignee: GOODRICH ACTUATION SYSTEM SAS, Buc (FR)

( * ) Notice: Subject to any disclaimer, the term of this patent is extended or adjusted under 35 U.S.C. 154(b) by 0 days.

(21) Appl. No.: 15/671,356

(22) Filed: Aug. 8, 2017

(65) Prior Publication Data

US 2018/0040984 A1 Feb. 8, 2018

(30) Foreign Application Priority Data

Aug. 8, 2016 (EP) ..... 16306027

(51) Int. Cl.

| | |
|---|---|
| ***H01R 33/00*** | (2006.01) |
| ***H01R 13/639*** | (2006.01) |
| ***E05F 15/60*** | (2015.01) |
| ***H01R 13/26*** | (2006.01) |
| ***H01R 13/631*** | (2006.01) |
| ***H01R 13/74*** | (2006.01) |
| ***H01R 13/52*** | (2006.01) |
| ***H01R 13/629*** | (2006.01) |
| *H01R 13/621* | (2006.01) |
| *H01R 107/00* | (2006.01) |

(52) U.S. Cl.

CPC ..... *H01R 13/6395* (2013.01); *E05F 15/60* (2015.01); *H01R 13/26* (2013.01); *H01R 13/5219* (2013.01); *H01R 13/629* (2013.01); *H01R 13/631* (2013.01); *H01R 13/74* (2013.01); *H01R 13/6215* (2013.01); *H01R 2107/00* (2013.01)

(58) Field of Classification Search

CPC ..... H01R 13/6395; H01R 13/26; H01R 13/5219; H01R 13/629; H01R 13/631; H01R 13/74; H01R 13/6215; H01R 2107/00; E05F 15/60

USPC ..... 439/660, 544–545

See application file for complete search history.

(56) References Cited

U.S. PATENT DOCUMENTS

| | | | |
|---|---|---|---|
| 4,722,698 | A | 2/1988 | Modschiedler |
| 5,622,511 | A | 4/1997 | Jarrett |
| 7,762,852 | B2 | 7/2010 | Daly et al. |
| 7,841,889 | B2 | 11/2010 | Gerard et al. |
| 2011/0189877 | A1 | 8/2011 | Svelnis et al. |
| 2012/0178303 | A1 | 7/2012 | Sakurai |

FOREIGN PATENT DOCUMENTS

| | | | |
|---|---|---|---|
| WO | 9508204 | A1 | 3/1995 |
| WO | 2015084246 | A1 | 6/2015 |

OTHER PUBLICATIONS

Extended European Search Report for International Application No. 16306027.0 dated Apr. 10, 2017, 12 pages.

*Primary Examiner* — Khiem M Nguyen

(74) *Attorney, Agent, or Firm* — Cantor Colburn LLP

(57) ABSTRACT

An electrical connection comprises a first connector, a second connector, a first wall surrounding the first connector, and a second wall surrounding the second connector. The first wall is configured to fit inside the second wall when the first and second connectors are connected. The first and second walls include leading faces comprising first and second chamfered portions, respectively. The first and second chamfered portions are angled complementarily for guiding the first wall inside the second wall during connection of the first and second connectors.

12 Claims, 6 Drawing Sheets

ELECTRICAL CONNECTION

FOREIGN PRIORITY

This application claims priority to European Patent Application No. 16306027.0 filed Aug. 8, 2016, the entire contents of which is incorporated herein by reference.

TECHNICAL FIELD

The present disclosure relates to an electrical connection between two parts, more specifically, the electrical connection between a flight control actuator for an aircraft and an electrical communication module used to control the actuator.

BACKGROUND

In modern aircraft it is well-known to provide flight control via electrical communication, in what is known as a "fly-by-wire" system. In such a system, pilot flight input controls are delivered to a control module which communicates the input controls to one or more flight control actuators, which in turn move one or more flight control surfaces to control the aircraft's movement.

In such a system, it is necessary to ensure a robust and reliable electrical connection between the control module and the actuator unit, so electrical communication is maintained throughout flight. In addition, the space for such connections can be very limited, and so it is advantageous to provide a means of guiding the connection, such that the control module can be easily disconnected and reconnected during maintenance operations.

The present disclosure aims to provide a connection that provides the above.

SUMMARY

From a first aspect, the present disclosure relates to an electrical connection. The electrical connection comprises a first connector and a second connector, configured to form a connection with the first connector. The electrical connection further comprises a first wall surrounding the first connector, and a second wall surrounding the second connector. The first wall is configured to fit inside the second wall when the first and second connectors are connected. The first and second walls include leading faces comprising first and second chamfered portions, respectively. The first and second chamfered portions are angled complementarily.

A connection axis is defined as the axis along which the first and second connectors are moved together to form a connection.

One of the connectors is a male connector and the other is a complementary female connector that is capable of forming an electrical connection therewith. Either of the first and second connectors can be male, as long as the other is a complementary female connector.

It is to be understood that the walls are distinct from the exterior of the connectors (i.e. the connector casings).

The leading faces of the first and second walls are the faces of the walls that are axially forward-most of the respective first and second connectors, along the connection axis, when the first and second connectors are being moved towards each other.

The chamfered portions are formed at an acute angle relative to the connection axis.

By "angled complementarily", it is meant that the chamfered portions have substantially the same gradient relative to the connection axis. In other words, the first and second chamfered portions are angled substantially parallel to each other (i.e. at substantially the same angle relative to the connection axis).

When the first and second connectors are moved towards each other (e.g. in order to establish a connection therebetween) the first and second walls may contact and interact with each other. The complementarily angled first and second chamfered portions will act to guide the movement of the first wall inside the second wall, which ensures the first and second connectors are properly aligned before they contact each other. This ensures a properly aligned connection can be made, and protects the connectors from damage or incorrect connection.

In a specific embodiment of the above electrical connection, the first and second chamfered portions are angled at about 45° relative to the connection axis. However, any other acute angle may be suitable and could be used within the scope of this disclosure.

Additionally or alternatively, in a further embodiment, the first and second walls extend axially, parallel to the connection axis, and the axial extension of the first and second walls is greater than that of the first and second connectors, respectively.

In a further embodiment of the above, the second wall has a greater axial extension than the first wall. The second wall may extend about, or at least, 1 mm more than the first wall.

In a further embodiment of any of the above, the leading face of the first wall features a less-angled portion radially inward of the first chamfered portion relative to the connection axis.

The less-angled portion is angled "less sharply" than the chamfered portion, relative to the connection axis. In other words, the less angled portion is angled further away from the connection axis than the chamfered portions, and so is angled closer to an axis perpendicular to the connection axis than the chamfered portions. The less-angled portion may be a flat portion that extends perpendicularly to the connection axis or a rounded portion.

In a further embodiment of any of the above, the first and second connectors are D-sub connectors, for example, corresponding to the MIL C 24308 standard. However, any suitable electrical connector or standard thereof can be used within the scope of this disclosure. For instance, other suitable connectors, in addition to D-subminiature connectors, may include DVI-type, VGA-type, Modular, HD-type, Centronics, USB, SCSI, DIN-type, Fiber, V.-type, Coax, Twinax, RCA and TRS connectors.

In a further embodiment of any of the above, the electrical connection further comprises a seal disposed around the first wall. The seal may form a hermetic seal between the first and second connectors when the first and second connectors are connected. The seal may be an O-ring seal. The seal may be made of a resilient material, such as an elastomer, for example, a rubber. One particular seal that maybe used is a DASH035 O-ring seal. However, any other suitable seal and seal material may be used within the scope of this disclosure.

The un-stretched perimeter of the seal (or circumference, when it is circular), may be less than the outer perimeter of the first wall, such that the seal is under tension when placed around the first wall. The seal's un-stretched perimeter, may, for example, be up to 5% shorter than the perimeter of the first wall.

In a further embodiment of the above, the first and second connectors further comprise one or more fastening members configured to secure the connection between the first and second connectors. Any suitable fastening arrangement that secures the electrical connection together can be used, for instance, a complementary/male-to-female arrangement such as a threaded member/bolt and nut arrangement, or a clamping arrangement.

In a further embodiment of the above, the electrical connection further comprises a first flange from which the first wall protrudes axially, parallel to the connection axis.

In a further embodiment of the above, the seal is compressed against the first wall, the first flange, and the second chamfered portion when the connection between the first and second connectors is secured by the one or more fastening members.

From a second aspect, the present disclosure relates to a method of connecting a control module to an actuator module using the electrical connection of the above embodiment of the first aspect. The method comprises the steps of stretching the seal to fit around the first wall; disposing the stretched seal on the first wall such that it contacts the first wall and the first flange; guiding the first wall inside the second wall using the first and second chamfered portions; connecting the first and second connectors; and compressing the stretched seal between the first wall, the first flange and the second chamfered portion by securing the connection between the first and second connectors using the one or more fastening members.

In a specific embodiment of the above method, the seal is stretched to increase its perimeter by up to 5%, between 3% and 5%, or about 3.5%.

From a third aspect, the present disclosure relates to an actuator assembly. The actuator assembly comprises an actuator module, a control module and the electrical connection of any of the embodiments of the first aspect. The electrical connection is configured to allow electrical communication between the control module and the actuator module. The actuator module comprises one of the first and second connectors and respective first or second wall, and the control module comprises the other of the first and second connectors and respective first or second wall.

In a specific embodiment of the above actuator assembly, the actuator assembly is configured to control one or more flight control surfaces of an aircraft.

From a fourth aspect, the present disclosure relates to a flight control module, also known as a Flight Control Electronic Module (FCEM). The flight control module comprises a first connector for connection to a second connector on an actuator assembly, a wall surrounding the first connector, a seal disposed around the wall and one or more fastening members for securing the connection between the first connector and a second connector. The wall comprises a leading face having a chamfered portion angled radially inwards towards the first connector.

The flight control module may have any of the features described above, for example, in relation to the first connector, the first wall, the seal and the control module of the actuation assembly.

The present disclosure also extends to a method of installing the flight control module by connecting the module to an actuator, such as a flight control surface actuator, as described above.

As described above in relation to the first aspect, the guidance provided by the first and second chamfered portions will align the first and second connectors to ensure a proper connection can be established therebetween. However, the guidance will also ensure proper alignment of the control module with the actuator module. This may make it easier to install the modules within a given space. Such alignment of the modules can also be important, when, for example, there are complementary fastening members provided on the modules. As will be understood, the alignment of modules through first and second walls will allow the male and female portions of such complementary fastening members to be properly aligned, which aids ease of securing the modules and the connection together. Thus, the first and second walls ensure proper alignment of the modules for installation and the connectors for connection.

In any of the above aspects, the first and second walls can be formed using any suitable material. In one specific embodiment, the first and second walls comprise a metallic material. When the metallic first and second walls overlap during connection of the first and second connectors, the metallic material may act to shield the first and second connectors from electromagnetic interference. One suitable metallic material may be aluminium or an alloy thereof. However, any other metallic material may be used, as required. The walls may be formed using any suitable manufacturing method, for instance, metallic walls may be machined, forged and/or cast as appropriate.

Although the present disclosure is described in the context of an aircraft system and flight control, the present disclosure can apply to any field where an electrical connection is necessary, for example, such as in computer-related hardware and automotive systems.

BRIEF DESCRIPTION OF THE DRAWINGS

Some exemplary embodiments of the present disclosure will now be described by way of example only, and with reference to the following drawings, in which.

DETAILED DESCRIPTION

Figure 1:
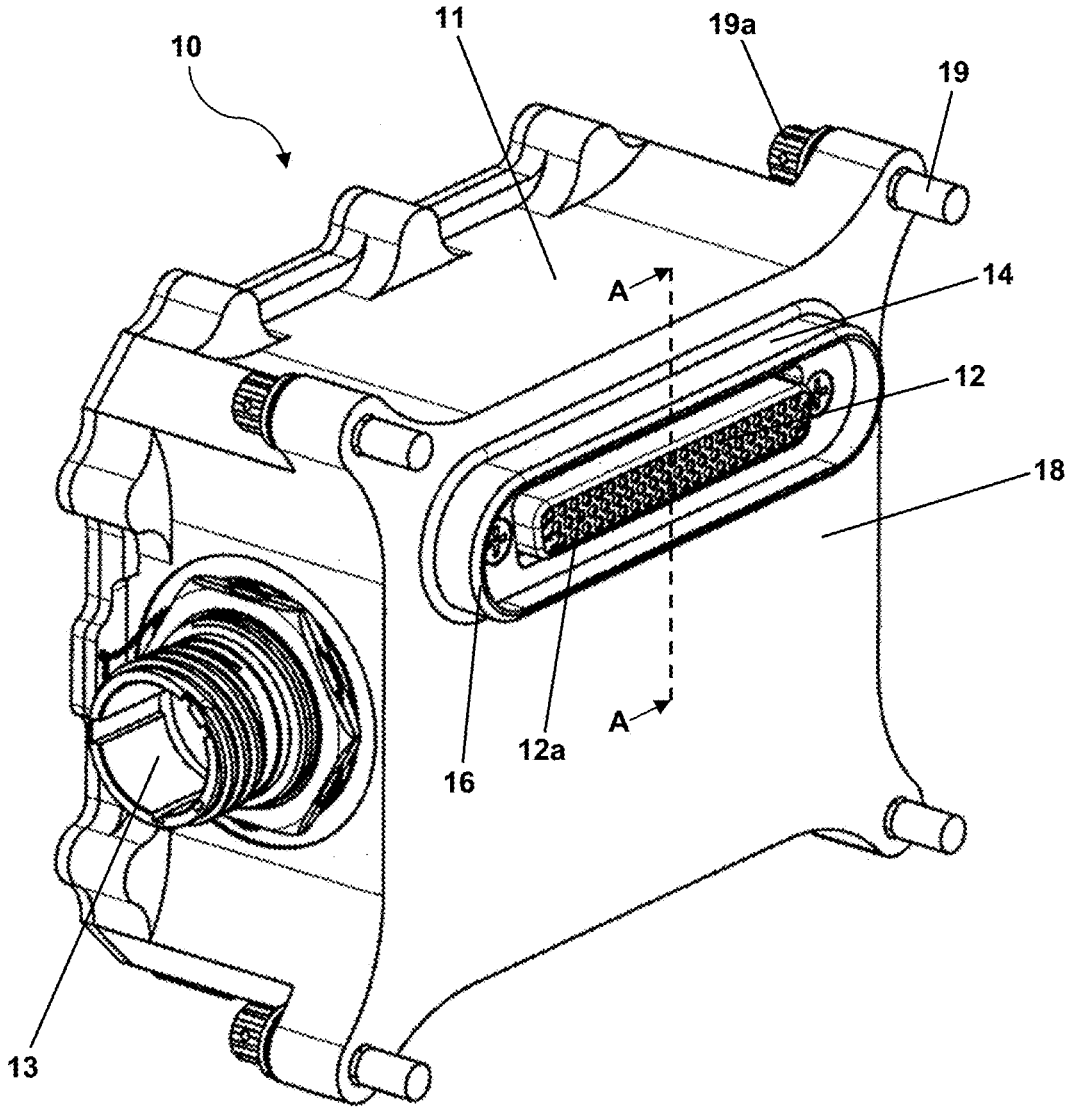
FIG. 1 shows a perspective view of an exemplary control module.
Figure 2:
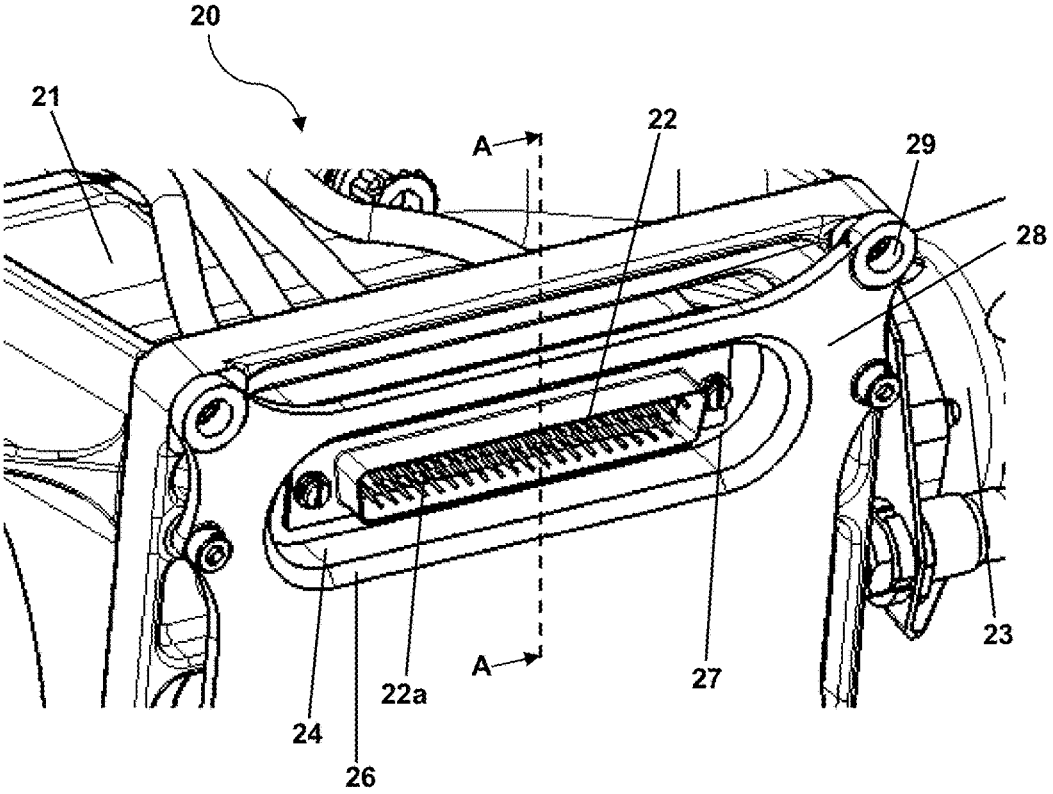
FIG. 2 shows a perspective view of a portion of an exemplary actuation module.

With reference to FIGS. 1 and 2, a control module 10 and an actuation module 20 are illustrated. Control module 10 and actuation module 20 are parts of an actuation assembly that is used to control the actuation of one or more flight control surfaces of an aircraft (not shown).

Control module 10 comprises a housing 11, first electrical connector 12 and cable routing 13. Actuation module 20 comprises a housing 21, second electrical connector 22 and actuator 23.

Actuator 23 may be any suitable type of actuator, as are known in the art, such as, for example, a ball-screw actuator or a hydraulic actuator.

Control module 10 and actuation module 20 are configured to be connected via first and second connectors 12, 22 to establish electrical communication therebetween. In this manner, first and second connectors 12, 22 form an electrical connection 100.

The first connector 12 is shown as a female connector having apertures 12*a* and the second connector 22 is shown as a male connector having pins 22*a*, which form contacts when the first and second connectors 12, 22 are connected. The first and second connectors 12, 22 shown are complementary D-subminiature connectors corresponding to the MIL C 24308 standard, having 62 contacts (i.e. 62 pins 22*a* and 62 apertures 12*a*).

Control module 10 is configured to receive and process pilot (or auto-pilot) flight control inputs. The processed inputs are then communicated, via the electrical connection 100 between the first and second connectors 12, 22, to actuation module 20, which actuates the flight control surfaces an appropriate amount based on the processed inputs. As is known in the art, such electrical control input is referred to as a "fly-by-wire" system.

The electrical connection 100 between control module 10 and actuator module 20 must remain secure during flight, so that the pilot (or auto-pilot) remains in control of the aircraft. As will be appreciated, certain flight conditions, such as turbulence or aircraft vibration can impart forces on the electrical connection 100. Thus, to ensure a secure connection during flight, the control module 10 is provided with a first flange 18 that includes fastening members 19 and the actuation module 20 is provided with a second flange 28 that includes co-operative fastening members 29.

By co-operative, it is meant that the fastening members 19, 29 are configured to fasten together and secure the flanges 18, 28 and thus the electrical connection 100, together.

In the depicted example, the fastening members 19 are threaded bolts protruding from apertures in the first flange 18, and fastening members 29 are threaded apertures disposed in the second flange 28 that co-operate with and engage the fastening members 19. The fastening members 19, 29 are fastened together by turning bolt head 19*a* on the bolts 19.

Although four of each fastening members 19 and 29 are depicted, any suitable number of co-operative fastening members 19 and 29 may be used within the scope of this disclosure, as will be determined by the specific actuation assembly being implemented.

A removable fastening arrangement allows the control module 10 and actuation module 20 to be separated from the actuation module 20 and replaced easily during maintenance activities.

Figure 3:
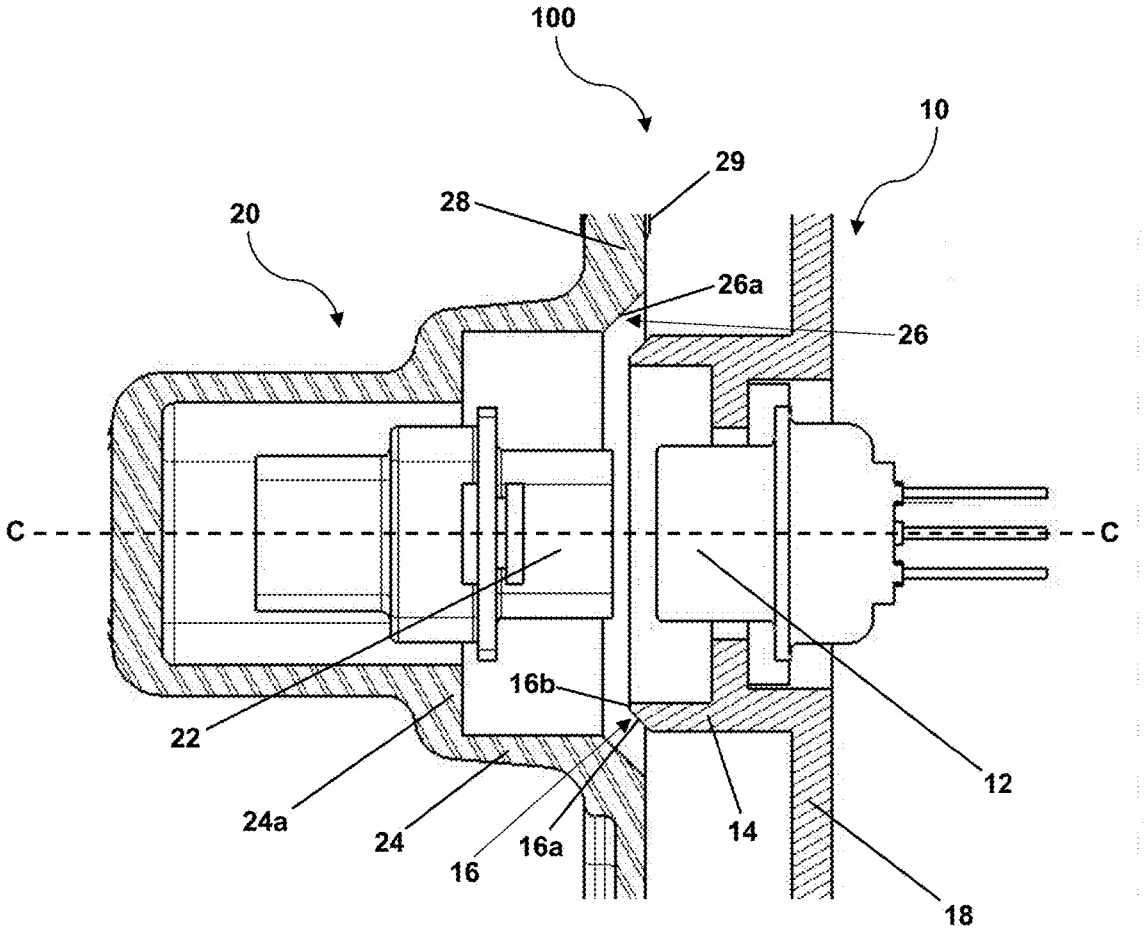
FIG. 3 shows a side cross-sectional view of an electrical connection through A-A, before connection has been established between the connectors of FIGS. 1 and 2.
Figure 4:
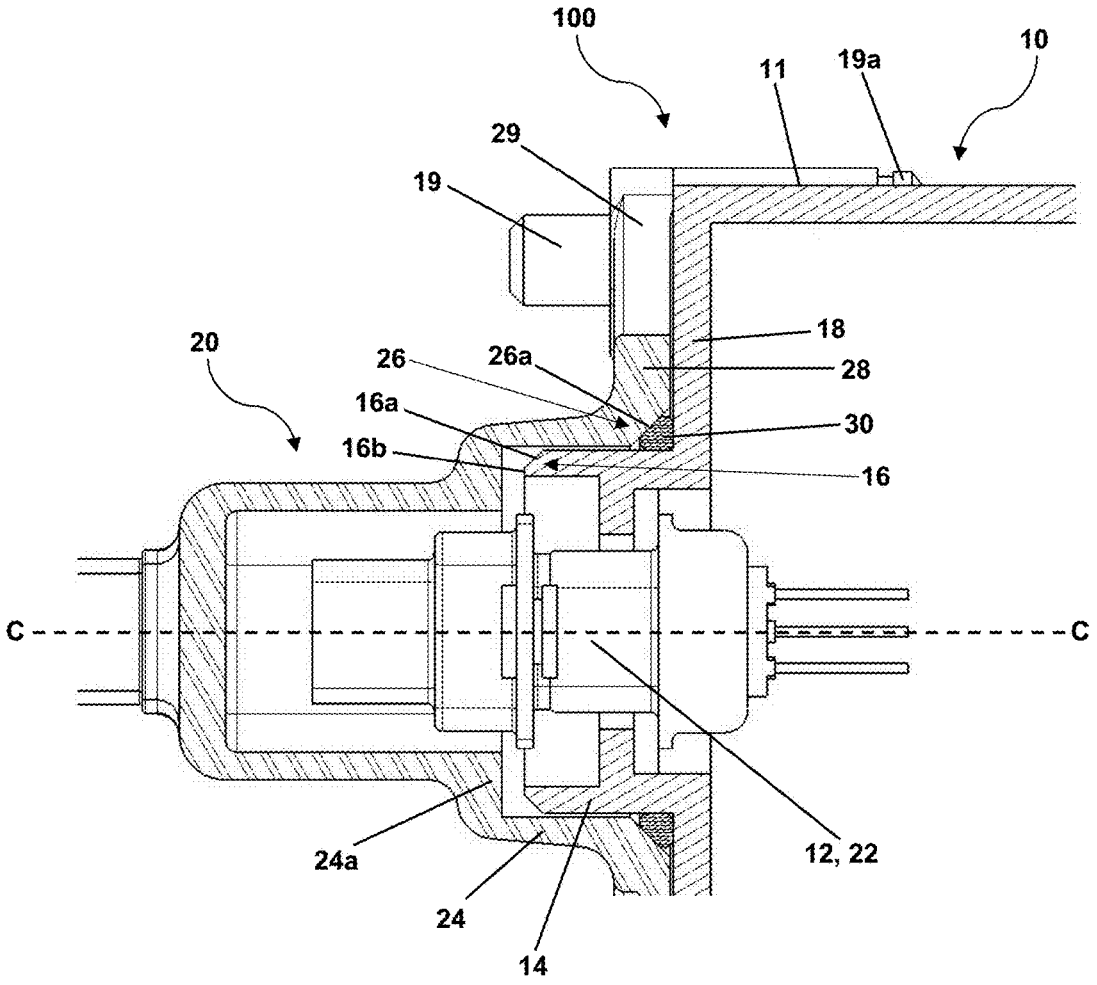
FIG. 4 shows a side cross-sectional view of an electrical connection through A-A, after connection has been established between the connectors of FIGS. 1 and 2, with a seal disposed around the first wall.

With additional reference to FIGS. 3 and 4, the first and second connectors 12, 22 are surrounded by respective, first and second walls 14, 24.

By surrounded, it is meant that the perimeter of the first and second electrical connectors 12, 22 is enclosed within the perimeter of the respective first and second wall 14, 24.

As will be explained further below, walls 14, 24 act to protect the connectors 12, 22 and guide the connectors 12, 22 into connection with each other.

First and second walls 14, 24 extend in an axial direction parallel to a connection axis C-C provided between the first and second connectors 12, 22 (i.e. the axis parallel to the extension of the apertures 12*a* and pins 22*a* of the first and second connectors 12, 22 making the connection, respectively).

The first wall 14 protrudes axially from the first flange 18 and the second wall 24 extends axially from a base portion 24*a* disposed radially inward thereof. The second flange 28 meets the second wall 24, such that a recess 27 is defined between the perimeter of the second wall 24.

In the depicted example, the first wall 14 is sized to fit inside the second wall 24, such that when the electrical connection 100 between connectors 12, 22 is formed, the first wall 14 is radially inward of the second wall 24 relative to the connection axis C-C.

In the depicted example, the first and second walls 14, 24 are shown as being integral parts of the first and second flanges 18, 28, respectively. However, it is to be understood, that first and second walls 14, 24 could instead be separate members that are attached to the flanges 18, 28 or are secured around the connectors 12, 22 themselves, without flanges.

As can be seen most clearly in FIG. 3, the first and second walls 14, 24 include first and second leading faces 16, 26 including complementary first and second chamfered portions 16*a*, 26*a*. First and second chamfered portions 16*a*, 26*a* are both angled at about 45° relative to the connection axis C-C.

The walls 14, 24 and complementary angle of the chamfered portions 16*a*, 26*a* helps guide the connectors 12, 22 into connection with each other and aids installation and/or removal of the control module 10 and actuation module 20 from an aircraft, where space and vision may be limited. For instance, if first and second connectors 12, 22 are not correctly aligned and connecting the control module 10 and actuation module 20 is attempted, the walls 14, 24 will co-operate to prevent misaligned insertion. As will be appreciated, this may prevent damage to the connectors 12, 22 and prevent incorrect installation. Additionally, the complementary angles of the chamfered portions 16*a*, 26*a* will co-operate to permit sliding of the first wall 14 into the second wall 24, which will aid alignment of the connectors 12, 22 and ease of installation.

As shown, first leading face 16 includes a less-angled portion 16*b* radially inward of the first chamfered portion 16*a*. Less-angled portion 16*b* prevents the first leading face 16 presenting a sharp edge. This prevents the first leading face 16 damaging the second leading face 26 and second chamfered portion 26*a*. Less-angled portion 16*b* is a flat edge extending substantially perpendicular to the connection axis C-C. Alternatively, less-angled portion 16*b* could be a straight edge that extends at a larger angle relative to the connection axis C-C than the chamfered portion 16*b* (i.e. angled closer to an axis perpendicular to the connection axis C-C than the chamfered portions 16*a*, 26*a*). The less-angled portion 16*b* could also be curved or rounded to achieve this. In other words, the less-angled portion 16*b* can be flattened or rounded off towards an axis perpendicular to the connection axis C-C.

Figure 5:
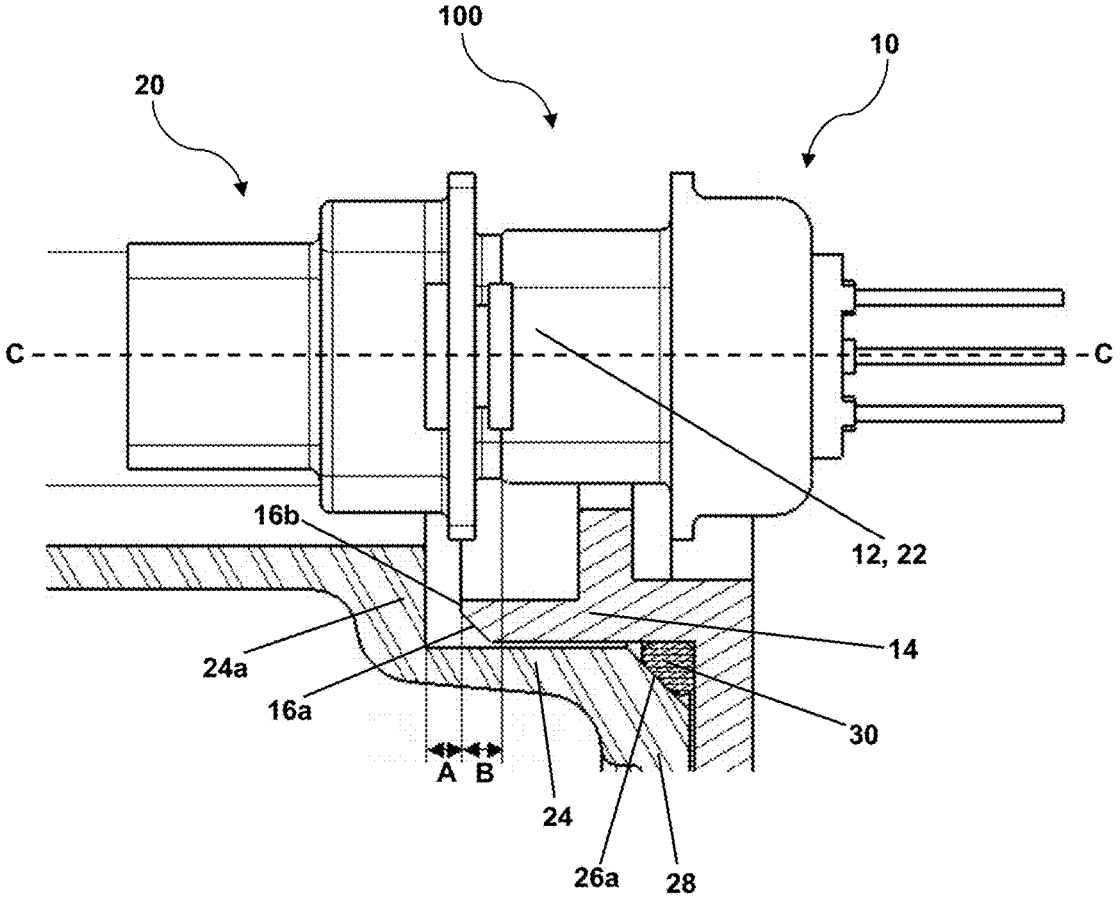
FIG. 5 shows a magnified view of a portion of FIG. 4.

As shown in FIG. 5, in order to protect the connectors 12, 22 from damage, the walls 14, 24 extend axially further than the tips of the connectors 12, 22 e.g. distance B between the tip of first connector 12 and the first leading face 16 (specifically, the less-angled portion 16*b*). Second wall 24 also extends axially further from the base portion 24*a* than the first wall 14 protrudes from the first flange 18, such that when the first wall 14 is inserted in the second wall 24 a gap A is left between the base portion 24*a* and the first leading face 16 (specifically, the less-angled portion 16*b*). This prevents potential damaging contact between the control module 10 and actuation module 20.

With reference to FIG. 4, a seal 30 is disposed around the first wall 14. When the first and second flanges 18, 28 are fastened together the seal 30 is compressed against the right angle formed by the first wall 14 and first flange 18 by the second chamfered portion 26*a*. The compression of seal 30 provides a hermetic seal between the flanges 18, 28, which offers additional environmental protection to the connection. For instance, seal 30 may prevent fluid contaminants from entering the connection, which could short-circuit the connection or corrode and/or otherwise damage the connectors 12, 22.

As shown, seal 30 is an O-ring seal and may be made of a resilient material, such as an elastomer (e.g. a rubber).

In order to ensure that seal 30 remains in place on first wall 14, it is sized such that it must be stretched over the first wall 14 to be installed. This ensures the seal 30 grips to the first wall 14.

The degree of stretch of seal 30 must be balanced with seal compressibility against the second chamfered portion 26*a*. In other words, if seal 30 is overstretched, it will not give enough compressibility to provide a good seal between the first and second walls 14, 24. Therefore, in certain embodiments, the seal 30 may be stretched to increase its circumference by up to 5%, or between 3% to 5%, or more specifically, to increase its circumference by about 3.5%. In embodiments where the seal is not an annular seal, then the stretch % increase is to a length around its perimeter, rather than its circumference.

The circumference of the seal 30 when it is stretched can be tailored to prevent it rolling along and off the first wall 14.

Figure 6:
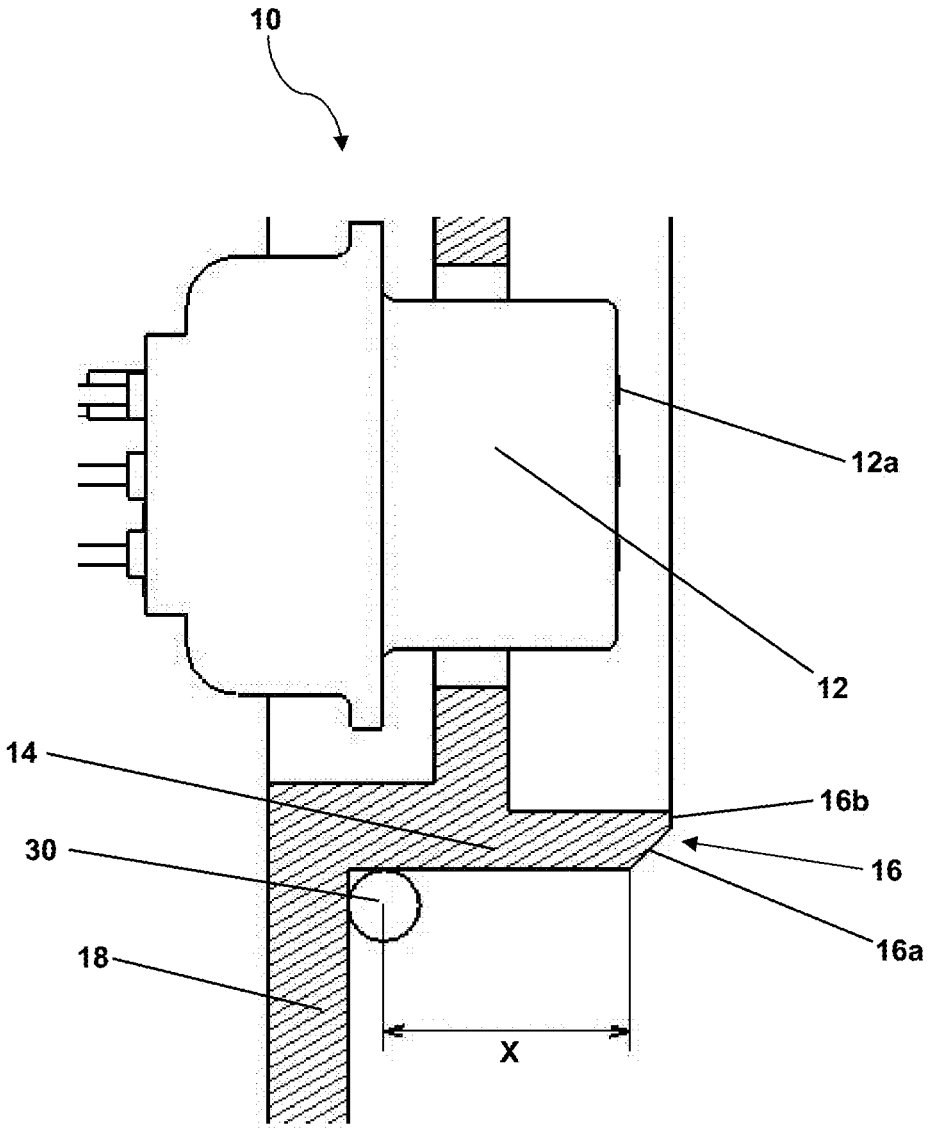
FIG. 6 shows a side cross-sectional through A-A of FIG. 1, with a seal disposed around the first wall.

FIG. 6 shows an axial distance X of the first wall 14, between the centre of seal 30, when the seal 30 is disposed against the first flange 18, and the less angled portion 16*b*. It has been found that making distance X greater than the stretched circumference of seal 30 will help prevent seal 30 from rolling off the first wall 14 during installation.

As discussed above, first leading face 16 has a less angled portion 16*b* to protect second chamfered portion 26*a* from damage. Preventing this damage helps maintain the compression and sealing action of the second chamfered portion 26*a* on seal 30, without damaging the seal 30.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

The invention claimed is:

1. An electrical connection comprising:

a first connector;

a second connector, configured to form a connection with the first connector, wherein the first and second connectors further comprise one or more fastening members configured to secure the connection between the first and second connectors;

a first wall surrounding the first connector;

a second wall surrounding the second connector, wherein the first wall is configured to fit inside the second wall when the first and second connectors are connected, and the first and second walls include leading faces comprising first and second chamfered portions, respectively, wherein the first and second chamfered portions are angled complementarily;

a seal disposed around the first wall; and a first flange, from which the first wall protrudes axially, parallel to the connection axis (C-C), wherein the seal is compressed against the first wall, the first flange, and the second chamfered portion when the connection between the first and second connectors is secured by the one or more fastening members.

2. The electrical connection of claim 1, wherein the first and second chamfered portions are angled at about 45° relative to the connection axis (C-C).

3. The electrical connection of claim 1, wherein the first and second walls extend axially, parallel to the connection axis (C-C), and the axial extension of the first and second walls is greater than that of the first and second connectors, respectively.

4. The electrical connection of claim 3, wherein the second wall has a greater axial extension than the first wall, for example, by 1 mm or greater.

5. The electrical connection of claim 1, wherein the leading face of the first wall features a less-angled portion radially inward of the first chamfered portion (16*a*) relative to the connection axis (C-C).

6. The electrical connection of claim 1, wherein the seal forms a hermetic seal between the first and second connectors when the first and second connectors are connected.

7. A method of connecting a control module to an actuator module using the electrical connection of claim 1, wherein the method comprises:

stretching the seal to fit around the first wall;

disposing the stretched seal on the first wall such that it contacts the first wall and the first flange;

guiding the first wall inside the second wall using the first and second chamfered portions;

connecting the first and second connectors; and compressing the stretched seal between the first wall, the first flange and the second chamfered portion by securing the connection between the first and second connectors using the one or more fastening members.

8. The method of claim 7, wherein the seal is stretched to increase its perimeter by up to 5%.

9. The method of claim 7, wherein the seal is stretched to increase its perimeter by between 3% and 5%.

10. The method of claim 7, wherein the seal is stretched to increase its perimeter by about 3.5%.

11. An actuator assembly comprising:

an actuator module;

a control module; and the electrical connection of claim 1, configured to allow electrical communication between the control module and the actuator module, wherein the actuator module comprises one of the first and second connectors and respective first or second wall, and the control module comprises the other of the first and second connectors and respective first or second wall.

12. The actuator assembly of claim 11, wherein the actuator assembly is configured to control one or more flight control surfaces of an aircraft.

* * * * *